US006397420B1

(12) United States Patent
Roxton

(10) Patent No.: US 6,397,420 B1
(45) Date of Patent: Jun. 4, 2002

(54) MANUAL EMERGENCY TOOL ASSEMBLY

(75) Inventor: George F. Roxton, Orland Park, IL (US)

(73) Assignee: Paratech Incorporated, Frankfort, IL (US)

( * ) Notice: Subject to any disclaimer, the term of this patent is extended or adjusted under 35 U.S.C. 154(b) by 0 days.

(21) Appl. No.: 09/323,318

(22) Filed: Jun. 1, 1999

(51) Int. Cl.[7] ..... B25D 1/04
(52) U.S. Cl. ..... 7/145; 7/158; 7/166; 81/177.2
(58) Field of Search ..... 7/158, 166, 167, 7/145; 81/177.2, 177.8; 403/321, 323

(56) References Cited

U.S. PATENT DOCUMENTS 1,030,592 A * 6/1912 Leland
2,382,291 A * 4/1945 Carlberg
2,377,730 A * 6/1945 Vosbikian et al.
2,820,626 A * 1/1958 Hedeen
3,219,316 A * 11/1965 Fried
3,489,451 A * 1/1970 Guckenberger
3,779,107 A * 12/1973 Avery ..... 81/177.8
3,883,117 A * 5/1975 Powell
4,701,074 A * 10/1987 Hall ..... 403/323
5,105,493 A * 4/1992 Lugtenaar
5,114,264 A * 5/1992 Barlow ..... 403/323
5,176,363 A * 1/1993 Bowlin
5,193,419 A * 3/1993 Lee ..... 81/177.2
5,428,853 A * 7/1995 Menke et al.

* cited by examiner

*Primary Examiner*—Joseph J. Hail, III
*Assistant Examiner*—Joni B. Danganan
(74) *Attorney, Agent, or Firm*—Jon C. Gealow

(57) ABSTRACT

A manual emergency tool assembly including a pair of tools, each of which has an operating head and a handle. The handles are formed to be telescopically engaged with each other. A locking arrangement is provided to secure the handles to each other in a fully telescoped relationship, and in intermediated telescoped relationships. A further locking arrangement provides for limited axial movement of the handles with respect to each other. The locking arrangement also provides for separating the tools for independent use of each tool or for use of the tools together in a configuration other than with the handle in a telescopic relationship.

5 Claims, 2 Drawing Sheets

MANUAL EMERGENCY TOOL ASSEMBLY

FIELD OF THE INVENTION

The present invention relates to a manual emergency tool assembly of the typed used for instance by fire persons and rescue squad personnel. More particularly it relates to a manual tool assembly having two operating heads, each of which is designed for different uses, and each of which has a handle. The handles are designed to be telescopic with respect to each other, and may be secured to each other in various moveable and fixed positions.

BACKGROUND OF THE INVENTION

Forcible entry tools have been provided in the past for use by firepersons and other emergency personnel. One such tool is shown in U.S. Pat. No. 3,219,316—Fried. The tool shown in that patent has been manufactured by the assignee of this invention. Like the present invention, the forcible entry tool set forth in the Fried patent comprised two tools, each of which was provided with a handle. One of the handles is received in a bore in the other in a telescoping arrangement. As shown in the Fried patent, a spring biased latch pin was provided to secure the handles in a fully retracted position with respect to each other. A pair of spring biased latch pins were also provided to secure the handle to the chopping blade in two alternate positions which were at right angles to each other. The forcible entry tool shown in the Fried patent provided for securing the handles to each other only in the fully retracted position. Further, the spring biased latch pins were subject to wear, the spring was subject to fatigue, and operation could be impaired by foreign material entering the bore housing the spring biased latch pin.

Accordingly, it would be advantageous to provide an emergency work tool, having an improved arrangement for securing the handles to each other in multiple fixed and variable positions for greater versatility in use. It would be further advantageous that the securing arrangement for securing the handles to each other be more robust than that provided in prior devices, and that the securing arrangement be assembled of components less subject to wear than the securing arrangements of prior devices. Thus, it has been found desirable to improve the forcible entry tool described in the previously mentioned Fried patent to enhance its uses and to improve upon the securing arrangement for connecting the handles of the two tools to each other.

SUMMARY OF THE INVENTION

It is an object of this invention to provide an emergency tool assembly comprising two tools, each provided with a handle. The handles are telescopic with respect to each other, and may be secured in various movable and fixed positions with respect to each other. It is a further object of this invention to provide a securing arrangement for securing the handles with respect to each other, which is readily operated by a user of the tool. It is another object of this invention to provide a securing arrangement for securing the handles with respect to each other, which is robust and not readily subject to detrimental wear, which would adversely effect its performance. It is still another object of this invention to provide a securing arrangement for securing the handles with respect to each other, wherein a manual actuating element of the securing arrangement is generally protected from damage during both use and storage of the emergency tool assembly.

An emergency tool assembly in accordance with this invention includes a pair of tools, each of which is provided with a handle. One of the handles is provided with a cylindrical bore which receives a cylindrical handle provided on the other tool. The tool having the handle with a cylindrical bore is provided with a securing arrangement housing at the end of the cylindrical handle opposite the tool head. The securing arrangement housing includes a recessed area in one of its outer faces for receiving a manual operating lever. The manual operating lever is connected to a first rotatable cylindrical locking pin which is received in a bore formed in the securing arrangement housing, which bore is perpendicular to and partially intersects the cylindrical bore for receiving the cylindrical handle of the other tool. The first rotatable cylindrical locking pin is provided with a semicircular notch which may be aligned with the cylindrical bore upon rotation of the pin by the manual operating lever, such that the cylindrical handle may reciprocate or telescope in the cylindrical bore. The cylindrical handle is provided with a semicircular notch which is aligned with the first locking pin when the tool handles are fully retracted with respect to each other. When the handles are fully telescoped, the first locking pin may be rotated, by the manual operating lever, to face the semicircular notch in the first locking pin away from the cylindrical handle, so that a portion of the locking pin is positioned in the semicircular notch in the cylindrical handle, thus locking the two handles to each other in a fully retracted position with respect to each other.

A second fixed locking pin is provided in the securing arrangement housing, on the diametrically opposite side of the cylindrical bore with respect to the first rotatable locking pin, and in a position perpendicular to and partially intersecting the cylindrical bore. A first elongated segmental shaped notch is provided in the cylindrical handle on the diametrically opposite the first semicircular notch. The second fixed locking pin is received in the first elongated segmental shaped notch. When the first locking pin is in the unlocked position, the two handles are free to telescopically or reciprocally move the length of the first elongated segmental shaped notch with respect to each other.

A circumferential semicircular groove is formed in the cylindrical handle at the end of the first elongated segmental shaped notch closest to the free end of the handle. A second elongated segmental shaped notch is formed in the cylindrical handle, between the free end of the cylindrical handle and the circumferential semicircular groove, on the diametrically opposite side of the handle from the first elongated segmental shaped notch. When the second fixed locking pin is positioned in the circumferential semicircular groove, the handles may be rotated 180 degrees with respect to each other, so that the second fixed locking pin can be aligned with the second elongated segmental shaped notch, and the two handles separated from each other.

Additional semicircular notches similar to the first semicircular notch may be formed in the cylindrical handle on the diametrically opposite side of the first elongated segmental shaped notch, intermediate its length, to permit the handles to be locked to each other in various telescoped or retracted positions.

DETAILED DESCRIPTION OF THE PREFERRED EMBODIMENT

Figures 1, 2, 2A, 2B:
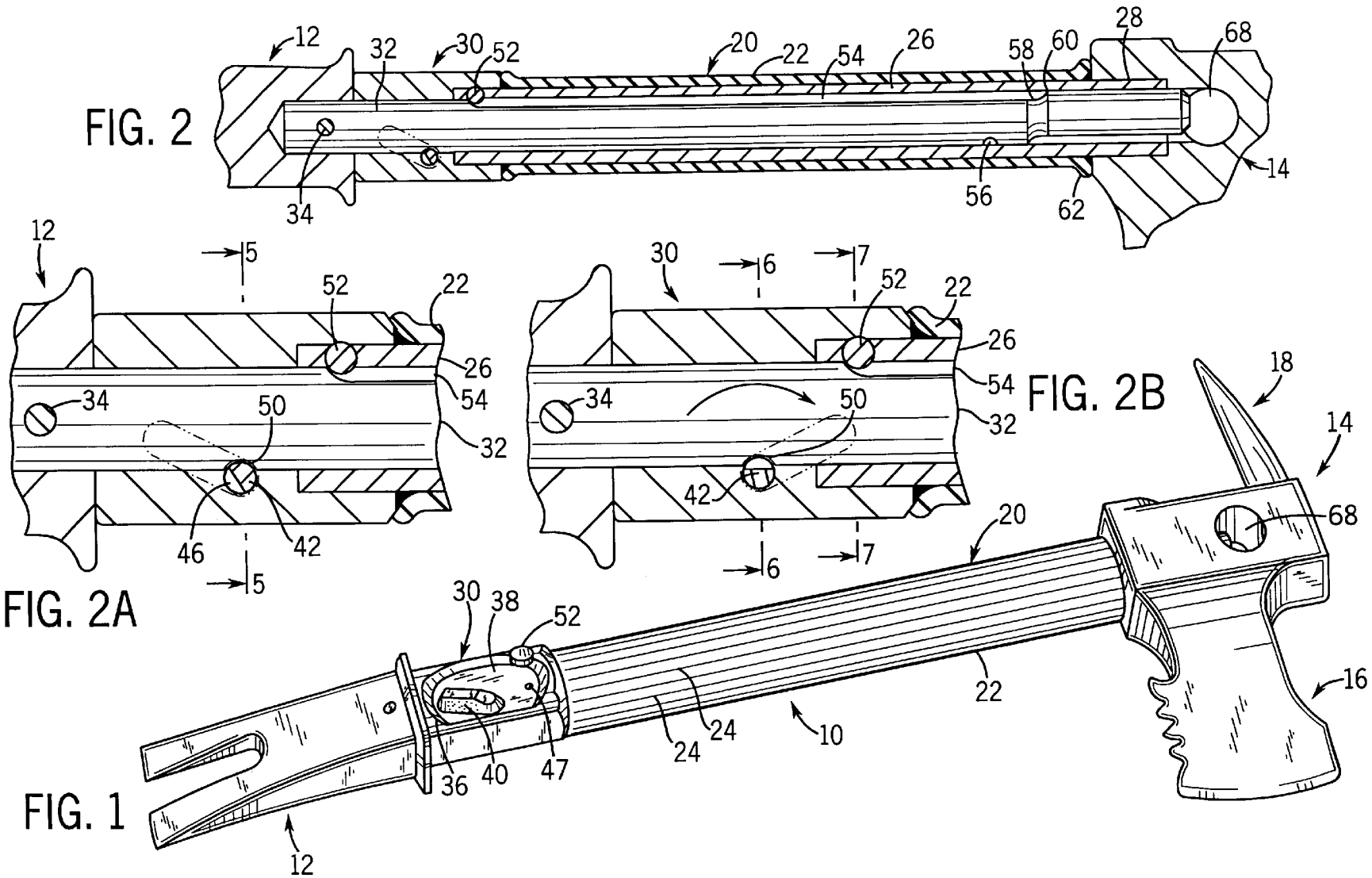
FIG. 1 is a perspective view of the manual emergency tool assembly of this invention shown with the handles of the two tools fully retracted with respect to each other.
FIG. 2 is a partial cross-sectional view of the handles and a portion of the operating heads of the manual emergency tool assembly of this invention as shown in FIG. 1.
FIG. 2A is an enlarged cross-sectional view of the left end of the handles as shown in FIG. 2 with a first rotatable locking pin in a first position.
FIG. 2B is an enlarged cross-sectional view of the left end of the handles as shown in FIG. 2, with the first rotatable locking pin in a second position.
Figure 6:
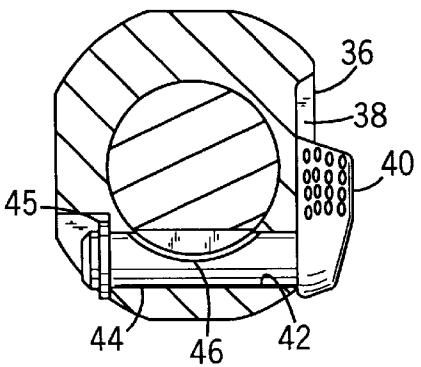
FIG. 6 is a cross-sectional view taken along the line 6—6 in FIG. 2B.
Figure 5:
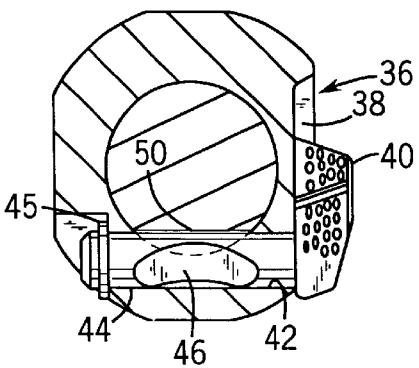
FIG. 5 is a cross-sectional view taken along the line 5—5 in FIG. 2A.

Referring to FIG. 1, the manual emergency tool assembly 10 of this invention includes a prying claw 12 and a head 14 which includes a blade 16 and a pike 18. The head 14 is provided with a handle 20 having an outer sleeve 22 formed with longitudinally extending ridges 24, thus providing a surface which is readily grasped in a users hand. In the preferred embodiment of this invention, the outer sleeve 22 is formed of a rubber like material. Secured within the outer sleeve 22 is a cylindrical tube 26. The cylindrical tube 26 extends within a bore 28 formed in the head 14 and is fixedly secure in the bore 28. Secured to the end of the cylindrical tube 26 opposite the head 14 is a securing arrangement housing 30 which is provided with a mechanism for locking the handle 20 of head 14 to a solid cylindrical handle 32 which is secured to the prying claw 12 by a roll pin 34 as best seen in FIG. 2. Side 36 of housing 30 is provided with a oval shaped depression 38 for receiving manual operating lever 40 which is secured to a rotatable cylindrical locking pin 42 for rotation therewith. As best shown in FIGS. 5 and 6, the locking pin 42 is received in a bore 44 formed in housing 30. The end of the locking pin 42 opposite the lever 40 is provided with a circumferential groove for receiving a snap ring 45 to secure the locking pin 42 in the bore 44. A pair of depressions, one of which 47 is shown, are formed in the oval shaped depression 38 to be engaged by a spring loaded detent in the lever 40, secure the lever in positions shown in FIGS. 2A and 2B. The locking pin 42 is provided with a semicircular notch 46 having a radius corresponding to that of the internal diameter of the cylindrical tube 26. When the notch 46 is facing the cylindrical handle 32, the locking pin 42 does not restrict the movement of the cylindrical handle 32 with respect to the cylindrical tube 26.

Figure 3:
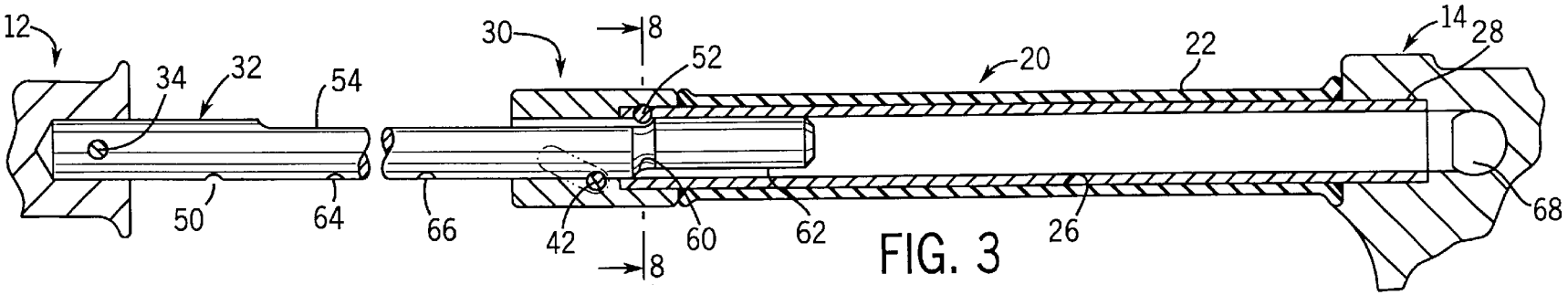
FIG. 3 is a cross-section view similar to FIG. 1, with the handles locked in a fully extended position with respect to each other.
Figure 4:
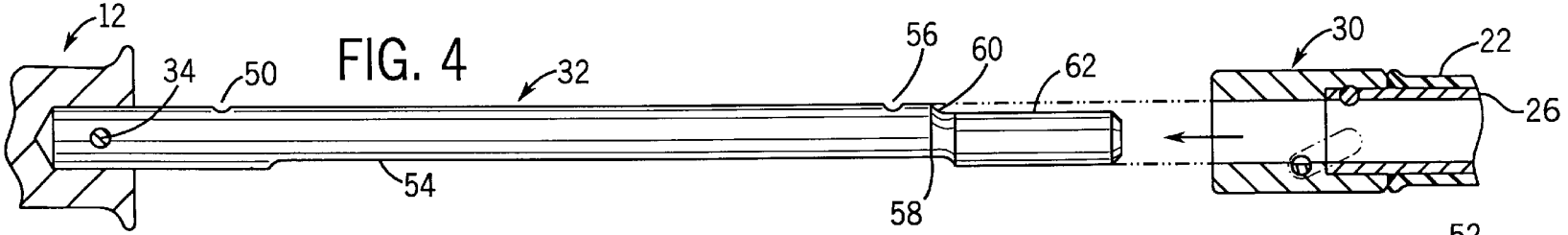
FIG. 4 is a cross-sectional view similar to FIGS. 1 and 2, with the handles separated from each other.
Figure 7:
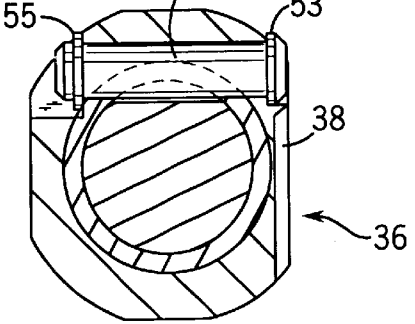
FIG. 7 is a cross-sectional view taken along the line 7—7 in FIG. 2B.
Figure 8:
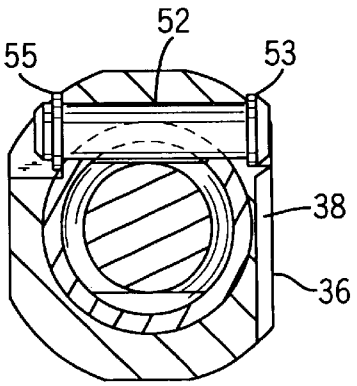
FIG. 8 is a cross-sectional view taken along the line 8—8 in FIG. 3.

Referring to FIGS. 3 and 4, the solid cylindrical handle 32, secured to the prying claw 12 by the roll pin 34 received in aligned holes in both members, is provided with a plurality of semicircular grooves to be engaged by the rotatable locking pin 42 for securing the solid cylindrical handle 32 and the handle 20 in different fixed positions with respect to each other. As shown in FIGS. 2, 2A, and 5, the semicircular notch 46 in locking pin 42 is facing away from the cylindrical handle 32, such that the rotatable locking pin 42 is engaged in a semicircular notch 50 in handle 32, thus locking the handles in a fully retracted position with respect to each other. Rotating locking pin 42 to the position shown in FIG. 2B and 6, by actuating the lever 40, frees the cylindrical handle 32 from engagement with the locking pin 42. Thus, handles 20 and 32 are not restricted in movement with respect to each other by the locking pin 42. However, engagement of a fixed locking pin 52 in an elongated segmental shaped slot 54 in handle 32 limits the reciprocal movement of the two handles with respect to each other to the length of the elongated slot 54. The fixed locking pin 52 is provided with a head 53 at one end and a groove at the other end to receive snap ring 55 which secure the locking pin 52 in a bore in the housing 30.

A semicircular notch 56 is provided in the cylindrical handle 32 close to the end 58 of the elongated slot 54 opposite the end to which the prying claw 12 is secured. If locking pin 42 is rotated to be positioned in the semicircular notch 56, the handles are secured in a fixed extended position with respect to each other, thereby providing a longer operating handle for both of the operating heads.

If it is desirable to separate the handles from each other, the handles 20 and 32 are moved apart from each other until the fixed locking pin 52 is at the end 58 of the elongated slot 54. A circumferential semicircular groove 60 is provided at the end 58 of elongated slot 54. With the fixed locking pin 52 located in the circumferential semicircular groove 60, the handles 20 and 32 may be rotated with respect to each other, so as to align the locking pin 52 with a second elongated segmental shaped slot 62, which is located diametrically opposite elongated segmental shaped slot 54, and extends from the circumferential groove 60 to the free end of the handle 32. With the locking pin 52 located in the elongated slot 62, the handles 20 and 32 may be pulled apart and separated from each other.

As shown in FIG. 3, additional semicircular notches 64 and 66 may be formed in the handle 32, intermediate the length of elongated slot 54. Locking pin 42 may be rotated to be positioned in one of the semicircular notches 64 or 66, to thereby secure the handles 20 and 32 in intermediate extended positions with respect to each other.

By positioning the manual operating lever 40 within the oval shaped depression 38, it is quite well protected from inadvertent damage during the course of use of the tool. Further, wherein the manual operating lever 40 and rotating cylindrical locking pin 42 need only be rotated within the bore 44, damage or impairment of operation by foreign materials is highly unlikely.

With the two portions of the manual emergency tool secured in the fully retracted position as shown in FIGS. 1, 2, 2A and 5, the tool may be compactly stored and also used in operations not requiring greater leverage than that provided by the retracted handle length. When the handle 32 and shaft 34 are rotated to the position shown in FIGS. 2B, and 6, the handles may be reciprocated with respect to each other through the length of elongated slot 54. Such reciprocal movement is useful for instance in driving the prying claw between two members, such as a door and a door frame. By repetitively moving the head 14 away from and then forcefully toward prying claw, it acts as a battering ram for the prying claw.

By placing the pin 42 in one of the notches 64 or 66 intermediate the length of the elongated slot 54, the handles are rigidly secured to each other so as to provide a longer operating handle for increase leverage when using either the prying claw 12 or the head 14.

By positioning the pin 52 in the circumferentially extending semicircular notch 60, the two handles may be separated from each other, such that the two tools may be independently used. Further, the free end of cylindrical handle 32 may be placed in a hole 68 formed in the head 14, to provide leverage for twisting the blade 16 about its free end, which may be jammed between two members to pry them apart.

For a further understanding of the many varied uses of the manual emergency tool assembly of this invention, reference is again made to U.S Pat. No. 3,219,316—Fried, the teaching of which patent as to the use of such tools are hereby incorporated by reference.

While only one embodiment of the invention has been shown, it should be apparent to those skilled in the art that what has been described is considered at present to be a preferred embodiment of the manual emergency tool of this invention. In accordance with the Patent Statute, changes may be made in the manual emergency tool without actually departing from the true spirit and scope of this invention. The appended claims are intended to cover all such changes and modification which fall in the true spirit and scope of this invention.

What is claimed is:

1. A manual emergency tool assembly comprising:

A. a first operating head having a first handle extending therefrom, said first handle having a cylindrical shape, i. a first semicircular notch being formed therein adjacent to said first operating head, ii. a first elongated segmental shaped notch being formed therein on the diametrically opposite side of said first handle from said first semicircular notch, and axially spaced from said first semicircular notch and extending toward the free end of said first handle, iii. a circumferentially extending semicircular notch being formed therein at the end of said first elongated segmental shaped notch closer to the free end of said first handle, iv. a second elongated segmental shaped notch being formed therein on same side of said first handle as said first semicircular notch and extending from said circumferentially extending semicircular notch to the free end of said first handle, B. a second operating head having a second handle extending therefrom, said second handle having a cylindrical bore therein for receiving said first handle in a telescopic relationship, a securing arrangement housing attached to the end of said second handle opposite said second operating head, said securing arrangement housing having a cylindrical bore therein for receiving said first handle, a. a rotatable cylindrical locking pin being received in a first bore in said securing arrangement housing, said first bore being perpendicular to and partially intersecting the cylindrical bore in said second handle, said rotatable cylindrical locking pin having a semicircular notch therein which in a first position of said rotatable cylindrical locking pin may be aligned with the cylindrical bore, such that said first handle may be telescopically received and reciprocate in said second handle, with said first semicircular notch aligned with said rotatable cylindrical locking pin, said cylindrical locking pin may be rotated to a second position to face the semicircular notch in said cylindrical locking pin away from said first handle, such that a portion of the locking pin is positioned in said first semicircular notch to secure said first and second handle in a fully telescoped position with respect to each other, b. a fixed locking pin received in a second bore in said securing arrangement housing, said second bore being perpendicular to and partially intersecting the cylindrical bore, such that a portion of said fixed locking pin extends into said cylindrical bore, said second bore being located closer to said second handle than said first bore, and on the diametrically opposite side of said cylindrical bore in said second handle, whereby to insert said first handle in the cylindrical bore in said second handle, said rotatable cylindrical locking pin is rotated to align the semicircular notch therein with the cylindrical bore, and said second elongated segmental shaped notch is aligned with said fixed locking pin, said first handle being inserted until the fixed locking pin is located in the circumferentially extending semicircular notch, the handles being rotated with respect to each other until the fixed locking pin is aligned with the first elongated segmental shaped notch, further inserting said first handle in said second handle until said first semicircular notch is aligned with said rotatable cylindrical locking pin, rotating said cylindrical locking pin to face the semicircular notch in said cylindrical locking pin away from said first handle, such that a portion of the locking pin is positioned in said first semicircular notch to secure said first and second handle in a fully telescoped position with respect to each other.

2. The manual emergency tool assembly of claim 1, wherein a depression is formed in the outer surface of said securing arrangement housing for receiving a manual operating lever secured to said rotatable cylindrical locking pin for rotation therewith.

3. The manual emergency tool assembly of claim 2, wherein a detent arrangement is provide on said securing arrangement housing and said manual operating lever to hold said manual operating lever in said first or second positions.

4. The manual emergency tool assembly of claim 1, wherein a second semicircular notch is formed in said first handle diametrically opposite said first elongated segmental shaped notch, and near said circumferentially extending semicircular notch, whereby with said fixed locking pin located in said circumferentially extending semicircular notch, said rotatable cylindrical locking pin may be rotated to face the semicircular notch in said cylindrical locking pin away from said first handle, such that a portion of the locking pin is positioned in said second semicircular notch to secure said first and second handle in an extended position with respect to each other.

5. The manual emergency tool assembly of claim 4, wherein at least a third semicircular notch is formed in said first handle diametrically opposite said first elongated segmental shaped notch and between said first and second semicircular notches, whereby with said fixed locking pin located in said first elongated segmental shaped notch, said rotatable cylindrical locking pin may be rotated to face the semicircular notch in said cylindrical locking pin away from said first handle, such that a portion of the locking pin is positioned in said third semicircular notch to secure said first and second handle in a partially extended position with respect to each other.

* * * * *